United States Patent [19]

Swenson

[11] 4,020,744

[45] May 3, 1977

[54] CONTROL OF HYDRAULICALLY POWERED EQUIPMENT

[75] Inventor: William J. Swenson, Houston, Tex.

[73] Assignee: Raymond International Inc., Houston, Tex.

[22] Filed: Nov. 13, 1974

[21] Appl. No.: 523,502

[52] U.S. Cl. ..... 91/216 B; 91/290; 91/321; 91/330; 91/337

[51] Int. Cl.[2] ..... F01B 15/00; F01B 7/18; F01L 25/06

[58] Field of Search ..... 91/318, 290, 247, 252, 91/321, 216 B, 335, 337, 330; 92/13.6

[56] References Cited

UNITED STATES PATENTS

| | | | |
|---|---|---|---|
| 964,970 | 7/1910 | Hultquist | 91/290 |
| 1,723,449 | 8/1929 | Tolkien | 91/330 |
| 2,006,237 | 6/1935 | Eynard | 91/335 |
| 2,237,871 | 4/1941 | Stone | 91/335 |
| 3,007,451 | 11/1961 | Washburn et al. | 91/335 |
| 3,145,796 | 8/1964 | Padula | 91/318 |
| 3,207,043 | 9/1965 | Kay | 91/290 |
| 3,225,663 | 12/1965 | Pelisson | 91/318 |
| 3,302,974 | 2/1967 | Hlinsky | 91/318 |
| 3,376,791 | 4/1968 | Ashfield et al. | 91/337 |
| 3,780,621 | 12/1973 | Romell | 91/290 |

*Primary Examiner*—Paul E. Maslousky
*Attorney, Agent, or Firm*—Fitzpatrick, Cella, Harper & Scinto

[57] ABSTRACT

A hydraulically driven hammer is disclosed, along with valve actuation arrangements which operate to switch hydraulic forces on the hammer ram after preselected intervals following application of pressurized pilot fluid flows. These flows pass into a fluid accumulation chamber until a predetermined volume is accumulated after which continued pilot fluid flow produces valve actuation.

4 Claims, 6 Drawing Figures

Fig. 3.
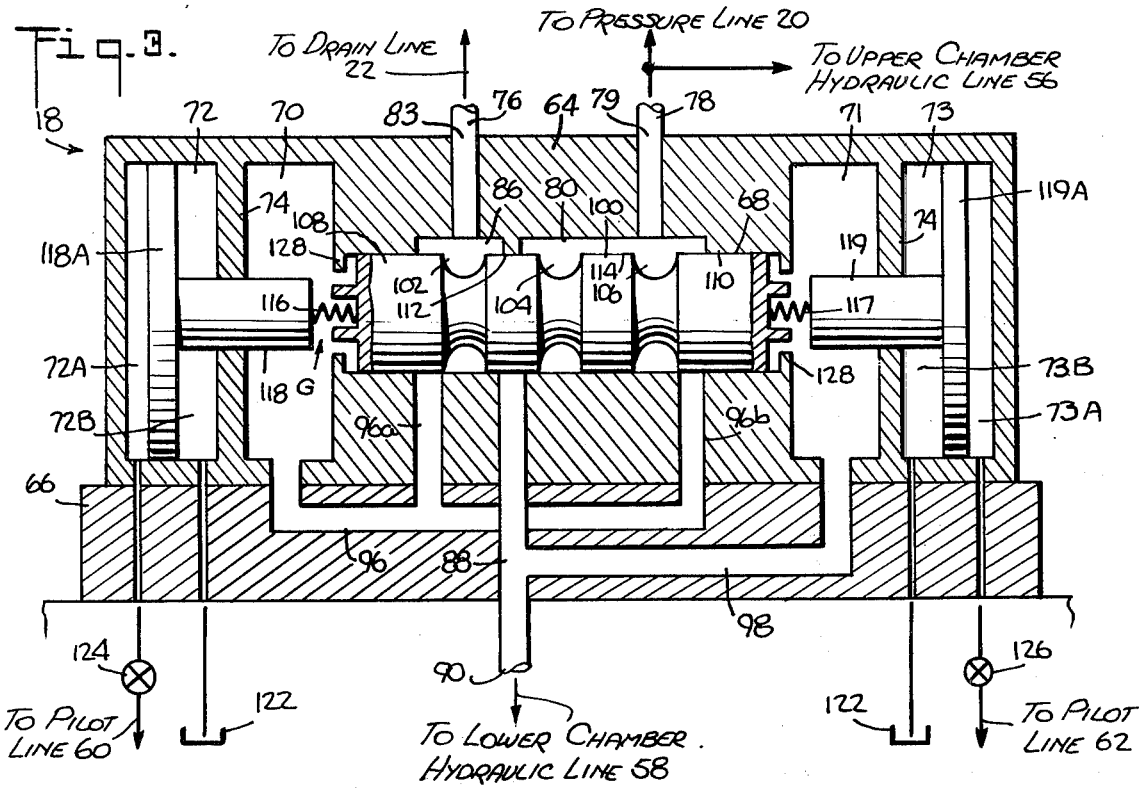
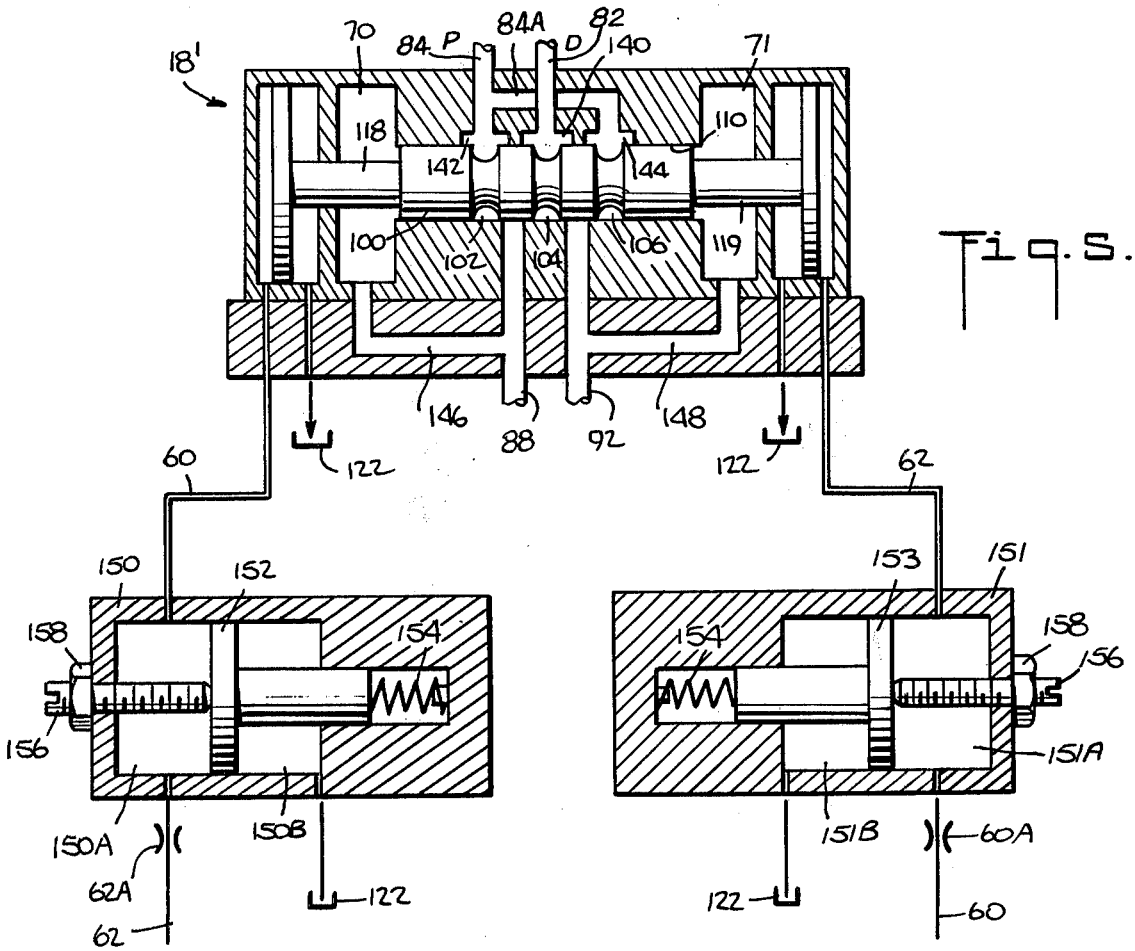
Fig. 5.

CONTROL OF HYDRAULICALLY POWERED EQUIPMENT

BACKGROUND OF THE INVENTION

1. Field of the Invention

This invention relates to the control of hydraulically powered equipment and more particularly it concerns novel means for improving the precision of actuation of such equipment.

2. Description of the Prior Art

The present invention is particularly useful in the control of operation of hydraulic pile driving hammers. These hammers employ hydraulic piston and cylinder means to move a heavy ram up and down so that it hammers on an anvil which rests on a pile or other element to be driven. Because of the inertia of the heavy ram, it does not respond instantaneously to a reversal of forces in the hydraulic piston and cylinder means which moves the ram. The actual switching of hydraulic forces in the piston and cylinder means must take place before the ram reaches at least the upper end of its hammering stroke. Moreover, because of variations in hydraulic pressures, ground conditions and other factors, the timing of hydraulic switching should be variable in relation to ram position. That is, under some conditions the hydraulic switching should take place when the ram is at one position, while under other conditions the switching should take place when the ram is at a different position.

It has been proposed to effect hydraulic switching in hammering systems by use of pilot ports which open into the hydraulic piston and cylinder means at locations such that when the ram reaches a predetermined position, the ports become exposed to sudden changes in hydraulic pressure. These pressure changes, and their accompanying fluid flow, pass through pilot conduits to the main hydraulic valve of the system, normally referred to as the cycling valve. The pressurized fluid from the pilot system serves to actuate the valve and thereby switch or reverse the hydraulic forces which control ram movement.

The use of a pilot conduit which becomes exposed to hydraulic pressure only when the hammer ram reaches a predetermined position raises certain problems when the switching action is to be adjusted with respect to ram position. The flow of fluid through the pilot conduit system can, of course, be adjustably metered so as to delay, more or less, the complete actuation of the main hydraulic valve. Such metering, however, causes the valve actuation to take place quite slowly with a resultant loss of precision.

SUMMARY OF THE INVENTION

The present invention overcomes these problems of the prior art and provides a hydraulic switching system which is adjustable over a wide range without any loss in speed of valve action and without any loss in precision of timing.

According to the present invention, a pilot conduit system is provided at a fixed location in a hydraulic system to be controlled. A fluid accumulation chamber is also provided to receive a flow of pressurized fluid from the pilot system. This flow is initiated whenever the relatively moveable elements, i.e. the piston and cylinder, of the hydraulic system reach a set relative position. The fluid accumulation chamber is provided with means responsive to the pilot actuation port of the main hydraulic valve for producing actuation thereof. The time delay between the initiation of pilot fluid flow and main valve actuation can be controlled in various ways. In one preferred embodiment, described hereinafter, the rate of flow of pilot fluid to the accumulation chamber is adjustably metered. So long as the accumulation chamber volume is maintained large enough to permit the high pilot fluid flow rates, this pilot flow rate can be metered over a wide range to obtain a substantial variation in time delay without appreciably affecting the rapidity of valve actuation after the time delay has elapsed.

In another embodiment, also described herein, the time delay is adjusted by providing means for adjusting the chamber volume at which the switching of application of pilot flow forces to the hydraulic valve takes place. According to this second embodiment, a moveable piston in the accumulation chamber is provided with stop means which prevent further piston movement in response to continued application of pilot pressure. The distance between the normal position of the piston and the stop means is made adjustable. Any flow of pilot fluid into the accumulation chamber after the piston has reached the stop means cannot continue to accumulate in the chamber and therefore it passes the chamber and flows to the actuation port of the main hydraulic valve. The resistance of the main hydraulic valve to pilot pressure actuation is arranged to be greater than the resistance of the moveable piston to movement in the accumulation chamber.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis of the designing of other structures for carrying out the purposes of this invention. It is important, therefore, that this disclosure be regarded as including such equivalent constructions as do not depart from the spirit and scope of the invention.

BRIEF DESCRIPTION OF THE DRAWINGS

Several embodiments of the invention have been chosen for purposes of illustration and description, and are shown in the accompanying drawings forming a part of the specification, wherein:

FIG. 3 is an enlarged section view illustrating a hydraulic switching valve and pilot actuation arrangements used in the hammer system of FIGS. 1 and 2;

FIG. 5 is a view similar to FIG. 3 but showing a modified form of pilot actuation for the switching valve.

DETAILED DESCRIPTION OF THE PREFERRED EMBODIMENTS

Figure 1:
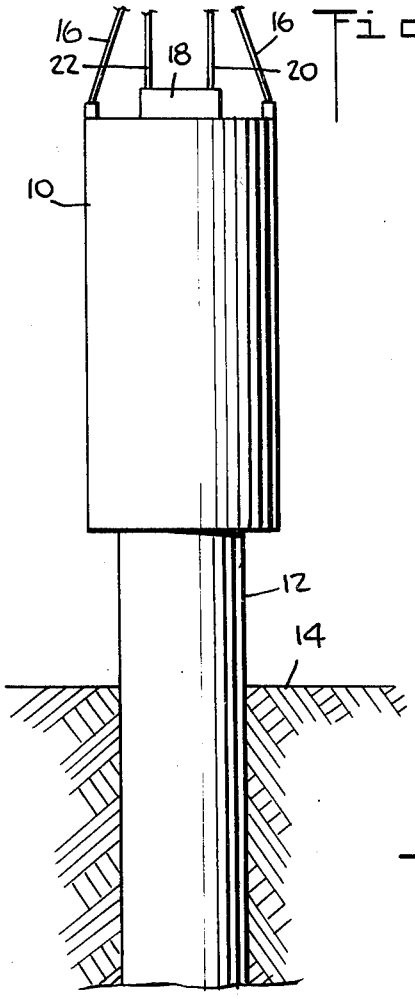
FIG. 1 is an elevational view, partially in section, showing a hydraulic hammer system, according to the present invention, driving a pile into the earth.

As can be seen in FIG. 1, a hammer assembly 10 rests on top of a pile 12 which the hammer assembly drives into the earth 14. The hammer assembly 10 is suspended by means of cable 16, from a pile driving rig (not shown). A hydraulic switching or cycling valve assembly 18 is mounted on top of the hammer assembly 10; and hydraulic pressure and drain lines 20 and 22 extend from the hydraulic switching valve assembly to a hydraulic pump and a hydraulic reservoir or tank (not shown) respectively. Pressure and drain accumulators (not shown) are interposed along the pressure and drain lines 20 and 22 respectively. The purpose for these accumulators is to accomodate fluid flow surges caused by operation of the cycling valve. The flow of hydraulic fluid into and out from the pressure and drain lines 20 and 22 serves to operate the hammer assembly for driving the pile into the earth.

Figure 2:
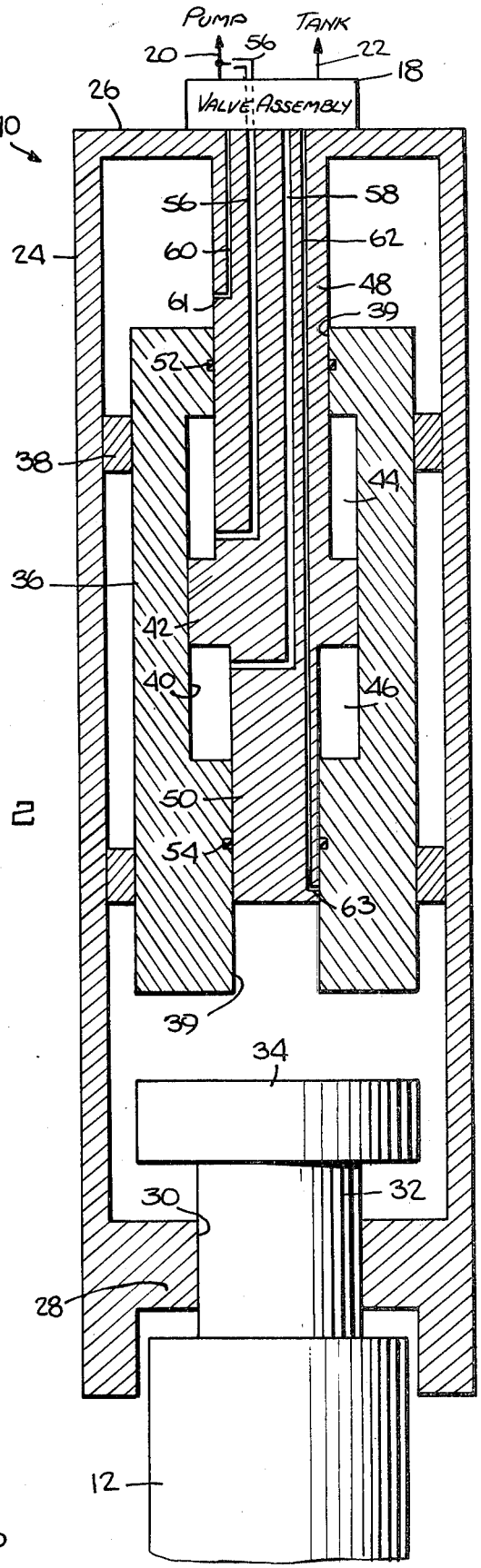
FIG. 2 is an enlarged section view illustrating the interior construction of the hydraulic hammer system of FIG. 1.

As can be seen in FIG. 2 the hammer assembly 10 comprises a tubular outer casing 24 having a top plate 26 and a bottom collar 28. The bottom collar 28 is provided with a central opening 30 through which an anvil stem 32 projects. As shown in FIG. 2, the bottom of the anvil stem 32 rests on the top of the pile 12. Actually, a cap block, well known in the art, can be interposed between the anvil stem 32 and the pile 12.

An enlarged anvil head 34 is formed on top of the anvil stem 32 within the tubular outer casing 24.

A cylinder ram 36 of massive construction is guided for axial movement within the tubular outer casing 24 by means of slide bearings 38 mounted inside the casing. The slide bearings 38 contact the outer surface of the cylinder ram 36 and support and guide it for axial movement up and down the tubular outer casing. As can be seen, the enlarged anvil head 34 lies in the path of movement of the massive cylinder ram 36, and a hammering action takes place as the cylinder ram impinges upon the enlarged anvil head 34. The energy of this hammering action is transmitted from the anvil head and through the anvil stem 32 to the pile 12.

The cylinder ram 36 is formed with an axial bore 39 having an enlarged cylinder portion 40. A stationary piston 42 is closely fitted inside the cylinder region 40. As can be seen, the piston 42 divides the cylinder region 40 into upper and lower pressure chambers 44 and 46. The piston 42 has an upper, large diameter, piston stem 48 which extends through the upper end of the cylinder ram bore 39, and is secured to the top plate 26 of the outer tubular casing 24. A smaller diameter lower piston stem 50 extends from the bottom of the piston 42 through the lower end of the cylinder ram bore 39. Upper and lower pressure seals 52 and 54 surround the upper and lower piston stems 48 and 50 respectively where they pass through the cylinder ram 36; and these pressure seals serve to pressure isolate the upper and lower pressure chambers 44 and 46 from the interior of the tubular outer casing 24 as the cylinder ram 36 moves up and down within the casing. It will be appreciated that because of the different piston diameters within the upper and lower chambers 44 and 46 a differential hydraulic effect may be produced in them. That is, where equal hydraulic pressures are applied to both chambers, the greater diametrical surface areas of the lower chamber 46 result in a greater hydraulic force being produced therein, so that in such case the ram 36 would be driven downwardly.

An upper chamber hydraulic line 56 extends from the pressure line 20, around the hydraulic switching valve assembly 18 and down through the top plate 26 and the upper piston stem 48. This upper chamber hydraulic line opens out into the upper pressure chamber 44 just above the stationary piston 42. A lower chamber hydraulic line 58 extends down from the hydraulic valve assembly 18 through the top plate 26 and the upper piston stem 48. The lower chamber hydraulic line 58, it will be noted, extends down beyond the stationary piston 42 and opens out into the lower pressure chamber 46 just below the stationary piston.

An upper hydraulic pilot line 60 also extends downwardly from the hydraulic cycling or switching valve assembly 18 through the top plate 26 and the upper piston stem 48. This upper hydraulic pilot line 60 communicates with an upper pilot port 61 which opens out onto the periphery of the upper piston stem 48 at a location such that it becomes exposed to the hydraulic pressure in the upper pressure chamber 44 before the cylinder ram 36 has reached the top of its upward stroke. A lower hydraulic pilot line 62 also extends downwardly from the hydraulic switching valve assembly 18 through the top plate 26 and the upper piston stem 48. This lower hydraulic pilot line 62 continues down past the piston 42 and into the lower piston stem 50 where it communicates with a lower pilot port 63. This lower pilot port 63 opens out onto the periphery of the lower piston stem 50 at a location such that it becomes exposed to the pressure within the lower pressure chamber 46 before the cylinder ram 36 has reached the bottom of its downward stroke and before it has contacted the anvil head 34.

During operation of the hammer assembly 10, pressurized fluid is supplied to the hydraulic switching valve assembly 18 via the pressure line 20, while expended fluid is drained out from the valve assembly 18 through the drain line 22. The hydraulic switching valve assembly 18, as will be described more fully hereinafter, operates to switch the lower chamber hydraulic line 58 alternately between the pressure and drain lines 20 and 22, while the upper chamber hydraulic line 56 remains connected to the pressure line 20. Thus the upper (smaller) chamber 44 always remains at pump pressure, while the lower (larger) chamber 46 is switched back and forth from pump to drain pressure. When the lower chamber is at drain pressure the hydraulic force produced therein is overcome by the hydraulic force in the upper chamber 44 and the cylinder ram 36 rises. During this upward movement of the cylinder ram, fluid from the lower pressure chamber 46 is drained out through the lower chamber hydraulic line 58 which is connected via the hydraulic switching valve assembly 18 to the drain line 22.

When the upper pressure seal 52 moves up past the upper pilot port 61, the upper hydraulic pilot line 60 becomes exposed to the high pressure in the upper pressure chamber 44. As will be described more fully hereinafter, this application of high hydraulic pressure to the upper hydraulic pilot line 60 causes actuation of the hydraulic switching valve assembly 18 to occur after a first predetermined delay. This actuation places the lower chamber hydraulic line 58 in communication with the pressure line 20. As a result, high pressure is supplied to the lower pressure chamber 46. Since the lower chamber 46 is of larger diametrical area than the upper chamber 44 the net hydraulic effect of subjecting both chambers to pump pressure is to produce a downward force on the cylinder ram 36. This reversal of forces on the cylinder ram causes it eventually to move a downward adownward direction towards the enlarged anvil head 34. During this downward ram movement, fluid from the upper pressure chamber 44 is drained out via the upper chamber hydraulic line 56. As will be explained more fully hereinafter, the actuation of the switching valve assembly does not terminate when the cylinder ram moves down to where the upper pilot line 60 is no longer exposed to pressurized hydraulic fluid.

As the cylinder ram 36 continues its downward movement, it reaches a point where the lower pressure seal 54 moves down past the lower pilot port 63. At this point the lower hydraulic pilot line 62 becomes exposed to the pressure within the lower pressure chamber 46. The pressurization of the lower hydraulic pilot line 62 causes reactuation of the hydraulic switching valve assembly 18 to occur after a second predetermined delay. This reactuation causes a reversal of the pressure and drain connections to the lower chamber hydraulic line 58. The timing of the delays prior to actuation and reactuation of the hydraulic valve assembly 18 may be adjusted for precise control of application of hydraulic pressures to the cylinder ram 36 so that it will deliver maximum energy to the anvil head without, however allowing the ram to force the anvil head 34 down against the bottom collar 28 of the casing 24.

Turning now to FIG. 3, it will be seen the hydraulic switching valve assembly 18 comprises a valve block 64 which is mounted on a valve plate 66. The valve block 64 is formed with a horizontally extending central bore 68 which opens, at its opposite ends, into left and right enlarged feedback chambers 70 and 71. A pair of fluid accumulation chambers 72 and 73 are formed within the valve block 64 just beyond each of the feedback chambers 70 and 71, respectively. These fluid accumulation chambers are separated from their associated feedback chambers by means of partition walls 74.

The valve block 64 is formed with a pressure input channel 78 which interconnects an input pressure port 79, on the exterior of the valve block 64, with a pressure recess 80 opening into the central bore 68. indicated, pressure input port 79 is connected, as indicated to the pressure line 20. A drain channel 76 interconnects an input drain port 83 on the exterior of the valve block 64, with a drain recess 86 which opens out into the central bore 68 at a location axially displaced from the pressure recess 80. The drain port 84 is connected, as indicated, to the drain line 22.

An output channel 88 extends from the central bore 68, through the valve block 64 and the valve plate 66, to an output port 90. The output port 90 is connected, as indicated, to the lower chamber hydraulic line 58.

A first feedback channel 96 is formed in the valve plate 66 and extends back to the left feedback chamber 70. This channel has two branches, **96*a* and 96*b*, which open respectively, to the central bore 68 at locations axially aligned with the pressure and drain recesses 80 and 86 on opposite sides of the output channel 88. A second feedback channel 98 likewise extends through the valve plate 66 and interconnects the output channel 88 to the right feedback chamber 71**.

A valve spool 100 is fitted closely inside the central bore 68 and is moveable axially therein. The spool 100 is formed with three axially displaced peripheral grooves 102, 104 and 106 and two central lands 112 and 114.

The relative axial positions and dimensions of the pressure and drain recesses 80 and 86, the output channel 88 the feedback branches **96*a* and 96*b* and the lands and grooves of the valve spool 100 are such that when the valve spool is in its centered position, as shown in FIG. 3, the pressure recess 80 communicates respectively with the central and right hand peripheral grooves 104 and 106 of the valve spool 100 while the drain recess 86 communicates with the left hand peripheral groove 102. Also, at the time the output channel 88 is blocked by the left central valve spool land 112. The two feedback branches 96*a* and 96*b* are also blocked by the outer lands 108 and 110 when the spool is centered as shown in FIG. 3**.

When the valve spool 100 is shifted to the left, the pressure input channel 78 communicates, via the pressure recess 80 and the central peripheral spool groove 104 with the output channel 88. At the same time, the input drain channel 76 communicates, via the drain recess 86 and the left peripheral spool groove 102, with the left feedback branch **96*a*. The other feedback branch 96*b* is closed by the right spool land 110. Thus, in the left position of the valve spool 100, the output channel 90 is maintained in communication with pump pressure via the pressure line 20. The valve spool 100 is hydraulically held in the left shifted positioned by virtue of pressurized fluid applied from the pressurized output channel 88 and the second feedback channel 98 to the second feedback chamber 71 and the right end of the spool. Also, the left end of the spool is open to drain pressure in the first feedback chamber via the first feedback line 96 and its branch 96*a***.

When the valve spool 100 is shifted to right of center, the pressure recess 80 communicates, via the right peripheral groove 106 with the right branch **96*b* of the first feedback channel 96. At the same time the drain recess 86 communicates via the left peripheral valve spool groove 102 with the output channel 88. Thus in this position of the spool 100, the output channel 88, and the lower chamber hydraulic line 58, are in communication with the drain line 22. The valve spool 100, once shifted to this right hand position, is hydraulically held there by pump pressure applied to its left end in the left feedback chamber 70. This pump pressure is communicated from the pressure line 20 and the pressure input channel 78, through the pressure recess 80, the right hand peripheral spool groove 106 and the right branch 96*b* of the first feedback channel 96. At the same time, the right end of the spool 100 in the right feedback chamber 71 is subjected to drain pressure applied from the output channel 88 through the second feedback line 98**.

The valve spool 100 is biased toward its central position, as shown in FIG. 3, by means of a pair of centering compression springs 116 and 117 which extend, respectively, between each end of the valve spool 100 and an associated valve actuating piston 118 and 119.

The valve actuation pistons 118 and 119 are mounted for reciprocal movement, respectively in the left and right fluid accumulation chambers 72 and 73. These valve actuation pistons pass through a central opening in the associated partition walls 74 and contact the ends of the valve spool 100 after compressing their associated centering spring 116 and 117. The length of the pistons 118 and 119 is such that when they are in their normal unactuated position farthest away from the valve spool 100, as shown in FIG. 3, a gap G, of predetermined distance, exists between them and the facing ends of the valve spool 100.

As can be seen in FIG. 3 the valve acutation pistons 118 and 119 have large diameter portions 118A and 119A which divide their associated fluid accumulation chambers 72 and 73 into pressure and drain regions, 72A and 72B, and 73A and 73B, respectively, As shown, each of the drain regions 72B and 73B is connected to a reservoir 122. The pressure region 72A of the left fluid accumulation chamber is connected, via a first adjustable metering valve 124, to the upper hydraulic pilot line 60, while the pressure region 73A of the right fluid accumulation chamber is connected, via a second adjustable metering valve 126, to the lower hydraulic pilot line 62.

During operation of the hydraulic hammer, the valve assembly 18 of FIG. 3 serves to provide predetermined delays between the application of pressure to the upper and lower hydraulic pilot lines 60 and 62 and the actual actuation of the hydraulic switching valve assembly 18, and at the same time it serves to provide a very rapid and positive valve switching action. When pressurized hydraulic fluid is applied to the upper hydraulic pilot line 60, it flows past the first adjustable metering valve 124 at a rate determined by the adjustment of that valve. This fluid passes into the pressure region of 72A of the left fluid accumulation chamber 72 and causes the left valve actuation piston to begin moving rightwardly. The rate of piston movement can be controlled by adjustment of fluid flow rate into the accumulation chamber; and this in turn is obtained by setting of the metering valve 124. This establishes the time period which must elapse before the left valve actuation piston 118 comes into contact with the end of the valve spool 100. Continued flow of pressurized hydraulic fluid through the upper hydraulic pilot line 60 and into the left fluid accumulation chamber 72 serves to drive the actuation piston 118 and the valve spool 100 to the right, thereby maintaining the pressure line 20 into communication with only the upper chamber hydraulic line 56 and placing the drain line 22 into communication with the lower hydraulic chamber line 58. At the same time the high pressure fluid which flows into the right branch **96*b* of the first feedback line 96 will pressure the chamber 70 to produce a snap action actuation of the valve spool 100 as well as a hydraulic latching of the spool in its right hand position. Thus, the spool will remain in this position even after pilot pressure is removed from the chamber 72A and the actuation piston 118 returns to its left hand position. The valve spool 100 is shifted in the opposite direction by application of pilot pressure from the pilot line 62 through the metering valve 126 into the chamber 73A.** The valve spool shifting action takes place in a manner similar to that described above and the fluid switching and feedback to provide snap action and latching is as above described.

It will be noted that the bore 110 is provided with abutments 128 at each end. These serve to limit spool movement at positions where the above described alignments of lands grooves, recesses and channels take place; and they further serve to define the actual gap which must be transversed by either actuating piston 118 and 199 to switch the valve spool to its opposite position.

Figure 4:
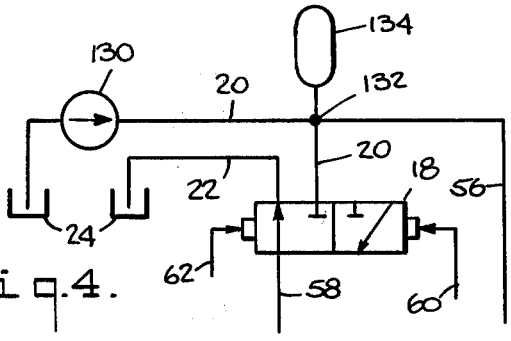
FIG. 4 is a schematic view of a hydraulic system incorporating the valve of FIG. 3.

FIG. 4 shows schematically a hydraulic system incorporating the valve arrangement of FIG. 3. As can be seen in FIG. 4, a pump 130 forces hydraulic fluid under high pressure to a junction 132 which leads to a high pressure fluid accumulator 134 and to the pressure line 20. The pressure line, as shown, is connected to one input of the valve assembly 18. The pressure line 20 is also connected to the upper chamber hydraulic line 56. The drain line 22 is connected to the other valve input and to a tank or drain reservoir 24. The lower chamber hydraulic line 58 is also shown connected to the valve. In the position shown, with pressure received from the pilot line 62, the valve connects the lower chamber hydraulic line 58 to drain pressure. When the valve is shifted to its opposite position, by application of pilot pressure through the pilot line 60, both the upper and lower chamber hydraulic lines 56 and 58 are connected to pump pressure.

While the above described arrangement makes use of the differential characteristics of the ram and piston arrangement of FIG. 2, the invention is also adaptable to a modification which provides for double action driving of the cylinder ram. In double action driving, the upper and lower hydraulic chambers 44 and 46 are each alternately switched between pump and drain pressure.

FIG. 5 shows a modification using a valve assembly 18′, similar to that of FIG. 3 but containing internal channels which provide complete reversal of the pressure and drain connections to the upper and lower chamber hydraulic lines 56 and 58. In FIG. 5 the drain channel 82 opens to a central pressure recess 140 at the valve spool bore 110, while the pressure channel 84 and a branch 84A thereof open to pressure recesses 142 and 144 axially displaced on either side of the drain recess 140. Also the first output channel 88 communicates via a left feedback channel 146 with the left feedback chamber 70 while the second output channel 92 communicates via a right feedback chanel 148 with the right feedback chamber 71. It will be appreciated that when the valve spool 100 is shifted to the right, the pressure input channel 76 is placed into communication with the first output channel 88 via the left peripheral spool groove 102 while the drain input channel 82 is placed into communication with the second output channel 92 via the central peripheral spool groove 104. The spool 100 is also held in this position by virtue of pressure feedback from the now pressurized first output channel 88 applied via the left feedback channel 146 to the left feedback chamber 70 and the left end of the spool 100 while drain pressure is applied from the drain connected second output channel 92 back through the right feedback channel 148 and the right feedback chamber 71 to right end of the spool 100.

When the spool 100 is shifted to the left the pressure input channel 76 is placed into communication with the second output channel 92 via the right peripheral groove 106 while the drain input channel 82 is placed into communication with the first output channel 88 via the central peripheral groove 104. Also a hydraulic latching action is achieved by virtue of pressure feedback from the output channels 88 and 92 to their respective feedback chamber 70 and 71.

In the arrangement of FIG. 5, the length of the valve actuation pistons 118 and 119 is such that when the valve spool 100 is in either its left or right extreme position, no gap exists between the end of the spool and the contact element toward which it is shifted. Thus the valve spool is moved immediately upon movement of that contact element.

As shown in FIG. 5 there are provided a pair of fluid accumulation chambers 150 and 151 associated, respectively, with the right and left sides of the hydraulic switching valve assembly 18'. The fluid accumulation chambers 150 and 151 are each provided with a fluid accumulation piston 152 and 153 which divides its respective accumulation chamber into a pressure region 150A or 151A, and a drain region 150B or 151B, respectively. The pistons 152 and 153 are biased by means of associated springs 154 in a direction so as to minimize the volume of their associated pressure regions 150A and 151A. The drain regions 150B and 151B are each connected to the reservoir 122 to accomodate the volumetric displacements of the pistons 152 and 153.

A setscrew 156 is threaded into the end of each fluid accumulation chamber along the axis of movement of the pistons 152 and 153. Bias springs 154 cause the pistons to abut the setscrews; and by adjusting the setscrews the initial volume of accumulation chambers can be controlled. The piston 152 and 153 are moveable against their bias springs 154 to a final position corresponding to a predetermined maximum volume of the accumulation chambers 150 and 151. By controlling the initial chamber volume through adjustment of the setscrews 156, it is possible to control the amount of volume increase and corresponding fluid accumulation capacity which occurs as a result of piston movement to this final position. The setscrews may be locked to any desired setting by means of locknuts 158 threaded thereon for abutment against the outer surface of the chambers. It is to be understood that the bias springs 154 need not be mechanical springs but instead they may be hydraulic or pneumatic means or any other equivalent resilient biasing means.

As shown in FIG. 5, the pressure regions 150A and 151A of the fluid accumulation chambers 150 and 151, are interposed along the upper and lower hydraulic pilot lines 60 and 62 respectively. Flow metering orifices **60*a* and 62*a* are also interposed along the pilot lines 60 and 62 adjacent the chambers 150 and 151. At all times the entire pilot system, including the pilot line and the initial volume of the fluid accumulation chamber pressure regions 150A and 151A, is filled with hydraulic fluid; although this fluid is not always at high pressure. When actuation of one side or the other of the hydraulic valve assembly 18' is to be initiated, the fluid in one or the other of the pilot systems is pressurized and it begins to flow toward the valve assembly. This flow of fluid is initially accommodated in moving the associated fluid accumulation piston 152 and 153 until it moves to its final position in its fluid accumulation chamber. Thereafter, continued fluid flow is transmitted through to the associated valve actuation piston 118 or 119 which causes movement of the valve spool 100**.

It will be appreciated that timing adjustment of the system of FIG. 5 is obtained by setting of the setscrews 156; and that during the timing period no fluid flow to the valve actuation pistons 118 and 119 has taken place; while after the timing period has elapsed full fluid flow in the valve actuation pistons takes place. Thus rapid and positive valve actuation is obtained for all variations in actuation delay.

Figure 6:
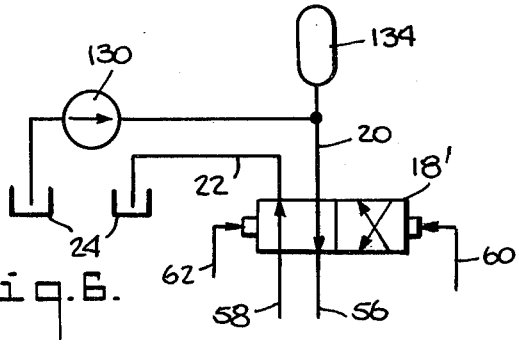
FIG. 6 is a schematic of a hydraulic system incorporating the valve of FIG. 5.

FIG. 6 shows schematically a hydraulic system incorporating the double acting valve arrangement of FIG. 5. As can be seen this system is similar to that of FIG. 4 with the exception that the valve assembly 18' of FIG. 6 serves in one position to convert the drain line 22 to the upper chamber hydraulic line 56 and the pressure line 20 to the lower chamber hydraulic line 58 while in its alternate position the valve assembly 18' reverses these connections.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. A hydraulically powered hammer with adjustable delay hydraulic switching, said hammer comprising a ram, means guiding said ram for reciprocal movement along a given path and against an anvil, hydraulic piston and cylinder means connected to move said ram, a hydraulic switching valve connected to control operation of said piston and cylinder means and including a housing, a valve spool mounted for reciprocal movement along a bore within said housing, said housing being formed with passageways for a fluid which follows different paths for different positions of said valve spool, a pilot pressure line extending from a position on said hammer to an end of said valve spool to accumulate flows of pressure fluid when said ram reaches predetermined positions for supplying pressurized hydraulic fluid to produce movement of said valve spool, said valve including feedback means to hold same in each switched position until an actuation force is applied to said valve, fluid accumulation means comprising a chamber connected to said pilot pressure line to receive said flow of fluid, and means including a piston moveable in said fluid accumulation chamber between a first position defining an initial minimum chamber volume and a second position defining a final maximum chamber volume and responsive to the accumulation of a predetermined volume of fluid in said accumulation means for applying an actuating force to said valve, means for adjusting the duration between initiation of said fluid flow and said accumulation of a predetermined volume of fluid, and means biasing said last mentioned piston toward said first position.

2. A hydraulic valve assembly according to claim 1 wherein said valve spool is biased against movement by flow of pilot fluid by an amount greater than the bias of said piston toward said first position.

3. A hydraulic valve assembly according to claim 1 wherein said fluid accumulation chamber includes adjustment means for adjusting said first position of said piston.

4. A hydraulic valve assembly according to claim 3 wherein said adjustment means comprises a setscrew extending into said cylinder along the path of movement of said piston.

* * * * *

UNITED STATES PATENT OFFICE

CERTIFICATE OF CORRECTION

Patent No. 4,020,744 Dated May 3, 1977

Inventor(s) WILLIAM J. SWENSON

It is certified that error appears in the above-identified patent and that said Letters Patent are hereby corrected as shown below:

Column 3, line 36, after the word "down" insert -- within --;

Column 5, lines 43-44, after the numeral "68." delete the word "indicated," and insert -- The --;

Column 7, line 26, delete the word "of";

lines 44-45, "pressure" to read -- pressurize --;

line 63, "transversed" to read -- traversed --;

line 64, "199" to read -- 119 --;

Column 8, line 52, after the numeral "71 to", insert -- the --.

Signed and Sealed this second Day of August 1977

[SEAL]

Attest:

RUTH C. MASON
*Attesting Officer*

C. MARSHALL DANN
*Commissioner of Patents and Trademarks*